US008154503B2

(12) United States Patent
Chung et al.

(10) Patent No.: US 8,154,503 B2
(45) Date of Patent: Apr. 10, 2012

(54) METHOD AND APPARATUS FOR DRIVING A LIQUID CRYSTAL DISPLAY DEVICE

(75) Inventors: Chun-Fan Chung, Hsinchu (TW); Sheng-Kai Hsu, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 408 days.

(21) Appl. No.: 12/551,868

(22) Filed: Sep. 1, 2009

(65) Prior Publication Data

US 2011/0050680 A1 Mar. 3, 2011

(51) Int. Cl.
*G09G 3/36* (2006.01)

(52) U.S. Cl. ..... 345/100; 345/214

(58) Field of Classification Search ..... 345/100, 345/214

See application file for complete search history.

(56) References Cited

U.S. PATENT DOCUMENTS 6,633,284 B1 * 10/2003 Hanari ..... 345/204
7,006,072 B2 * 2/2006 Ahn ..... 345/103
7,292,217 B2 11/2007 Tseng et al.
2005/0206629 A1 * 9/2005 Tseng et al. ..... 345/204
2005/0264548 A1 12/2005 Okamura et al.
2007/0013639 A1 1/2007 Lin et al.
2008/0211703 A1 9/2008 Tsuchi

* cited by examiner

*Primary Examiner* — Adam R Giesy
(74) *Attorney, Agent, or Firm* — Morris Manning & Martin LLP; Tim Tingkang Xia, Esq.

(57) ABSTRACT

The present invention in one aspect relates to a source driver comprising a first digital-to-analog converter with a positive polarity (PDAC), a second digital-to-analog converter with a negative polarity (NDAC), a first operational amplifier and a second operational amplifier. Each operational amplifier is characterized with a 1st & 2nd stage and an output stage. Both the PDAC and NDAC are coupled to the first and second operational amplifiers through a first pair of switches. The 1st & 2nd and output stages of the first operational amplifier are coupled to the 1st & 2nd and output stages of the second operational amplifier through a second pair of switches. The first and second operational amplifiers are coupled to odd data lines and even data line through a third pair of switches. Further, the amplitudes of the operational voltages for the PDAC, the NDAC and the output stages first and second operational amplifiers are set to be between the supply voltage and the ground voltage. Accordingly, the power consumption and the operational temperature are substantially reduced.

28 Claims, 7 Drawing Sheets

□ 60Hz, 2-Line dot Inversion, PWRC=H , CS enable（L,H）, ODLY disable

| | Full-AVDD | | Half-AVDD | | ΔT(℃) | ΔP(w) | Saving Ratio ΔP/P2 x100% |
|---|---|---|---|---|---|---|---|
| | P2(w) | T(℃) | P1(w) | T(℃) | | | |
| White | 9.756 | 80 | 9.06 | 72.7 | 7.3 | 0.696 | 7.13% |
| Black | 5.58 | 68.75 | 4.68 | 60.73 | 8.02 | 0.9 | 16.12% |
| Sub-v-stripe | 9.576 | 81.27 | 8.328 | 69.56 | 11.71 | 1.248 | 13.0% |
| H-stripe | 11.316 | 112.02 | 7.764 | 74.63 | 37.39 | 3.552 | 31.38% |
| Sub-checker | 10.56 | 93.4 | 8.676 | 77.26 | 16.14 | 1.884 | 17.84% |

(a)

□ 120Hz, Column Inversion, PWRC=H , CS disable , ODLY disable

| | Full-AVDD | | Half-AVDD | | ΔT(℃) | ΔP(w) | Saving Ratio ΔP/P2 x100% |
|---|---|---|---|---|---|---|---|
| | P2(w) | T(℃) | P1(w) | T(℃) | | | |
| White | 5.628 | 61.47 | 5.412 | 59.95 | 1.52 | 0.216 | 3.83% |
| Black | 5.868 | 67.02 | 5.28 | 63.37 | 3.65 | 0.588 | 10.02% |
| Sub-v-stripe | 5.832 | 64.8 | 5.496 | 62.00 | 2.8 | 0.336 | 5.76% |
| H-stripe | 16.86 | 160.05 | 11.184 | 89.72 | 70.33 | 5.676 | 33.66% |
| Sub-checker | 11.4 | 96.95 | 8.376 | 72.27 | 24.68 | 3.024 | 26.52% |

(b)

Fig. 5

METHOD AND APPARATUS FOR DRIVING A LIQUID CRYSTAL DISPLAY DEVICE

FIELD OF THE INVENTION

The present invention relates generally to a liquid crystal display (LCD), and more particularly, to a low-power-consumption source driver for an LCD and methods of driving same.

BACKGROUND OF THE INVENTION

Liquid crystal display (LCD) is commonly used as a display device because of its capability of displaying images with good quality while using little power. An LCD apparatus includes an LCD panel formed with liquid crystal cells and pixel elements with each associating with a corresponding liquid crystal cell and having a liquid crystal capacitor and a storage capacitor, a thin film transistor (TFT) electrically coupled with the liquid crystal capacitor and the storage capacitor. These pixel elements are substantially arranged in the form of a matrix having a number of pixel rows and a number of pixel columns. Typically, scanning signals, generated from a gate driver, are sequentially applied to the number of pixel rows, through a plurality of scanning lines along the row direction, for sequentially turning on the pixel elements row-by-row. When a scanning signal is applied to a pixel row to turn on corresponding TFTs of the pixel elements of a pixel row, source signals of an image to be displayed, generated from a source driver, for the pixel row are simultaneously applied to the number of pixel columns, through a plurality of data lines arranged crossing over the plurality of scanning lines along the column direction, so as to charge the corresponding liquid crystal capacitor and storage capacitor of the pixel row for aligning orientations of the corresponding liquid crystal cells associated with the pixel row to control light transmittance therethrough. By repeating the procedure for all pixel rows, all pixel elements are supplied with corresponding source signals of the image signal, thereby displaying the image signal thereon.

Liquid crystal molecules have a definite orientational alignment as a result of their long, thin shapes. The orientations of liquid crystal molecules in liquid crystal cells of an LCD panel play a crucial role in the transmittance of light therethrough. It is known if a substantially high voltage is applied between the liquid crystal layer for a long period of time, the optical transmission characteristics of the liquid crystal molecules may change. This change may be permanent, causing an irreversible degradation in the display quality of the LCD panel. To prevent the LC molecules from being deteriorated, the polarity of the voltage signals applied on the LC cell has to be changed continuously. Usually, a source driver is configured to generate such voltage signals having their polarity alternated according to an inversion scheme such as frame inversion, row inversion, column inversion, or dot inversion. Typically, one or more portions of the source driver are classified into the positive and negative types. The driving voltages for the positive and negative driver circuits are the same. However, the range of operational voltage is twice larger than that of the driver circuit with the single polarity. As a consequence, the power consumption of the source driver increases substantially. Additionally, notwithstanding the inversion schemes, a higher image quality requires higher power consumption because of frequent polarity conversions. Such LCD devices, in particular thin film transistor (TFT) LCD devices, may consume significant amounts of power, which may in turn generate excessive heat.

The characteristics of the LCD devices will be significantly deteriorated due to the heat generated.

Therefore, a heretofore unaddressed need exists in the art to address the aforementioned deficiencies and inadequacies.

SUMMARY OF THE INVENTION

In one aspect, the present invention relates to a source driver for driving a display having a plurality of pixels spatially arranged in a matrix form, and a plurality of data lines, each data line being associated with pixels of a corresponding pixel column. In one embodiment, the source driver includes a first pair of switches, S11 and S12, a second pair of switches, S21 and S22, and a third pair of switches, S31 and S32, controlled by a control signal, POL.

The source driver also includes a first level shifter having a first input for receiving an input data, a second input for receiving a power supply voltage, VDD, a third input for receiving a first middle voltage, VM1, and an output for outputting a first level-shifted signal of the input data, and a second level shifter having a first input for receiving the input data, a second input for receiving a second middle voltage, VM2, a third input for receiving a ground voltage, GND, and an output for outputting a second level-shifted signal of the input data.

The source driver further includes a first digital-to-analog converter with a positive polarity (PDAC) having a first input electrically coupled to the output of the first level shifter for receiving the first level-shifted signal therefrom, a second input for receiving the power supply voltage VDD, a third input for receiving the first middle voltage VM1, a fourth input for receiving a Gamma voltage, and an output for outputting a first converted signal, and a second digital-to-analog converter with a negative polarity (NDAC) having a first input electrically coupled to the output of the second level shifter for receiving the second level-shifted signal therefrom, a second input for receiving the second middle voltage VM2, a third input for receiving the ground voltage GND, a fourth input for receiving the Gamma voltage, and an output for outputting a second converted signal. In one embodiment, the first and second converted signals have positive and negative polarities, respectively.

Moreover, the source driver includes a first analog circuit having a first input electrically coupled to the output of the PDAC and the output of the NDAC through a switch S11 of the first pair of switches S11 and S12 for receiving the first converted signal from the PDAC or the second converted signal from the NDAC, a second input for receiving the power supply voltage VDD, a third input for receiving the ground voltage GND, and an output for outputting a first amplified signal, and a second analog circuit having a first input electrically coupled to the output of the PDAC and the output of the NDAC through a switch S12 of the first pair of switches S11 and S12 for receiving the first converted signal from the PDAC or the second converted signal from the NDAC, a second input for receiving the power supply voltage VDD, a third input for receiving the ground voltage GND, and an output for outputting a second amplified signal. In one embodiment, the first analog circuit and the second analog circuit are identical to or different from each other.

Additionally, the source driver includes a first output stage with a positive polarity having a first input electrically coupled to the output of the first analog circuit and the output of the second analog circuit through a switch S21 of the second pair of switches S21 and S22 for receiving the first amplified signal from the first analog circuit or the second amplified signal from the second analog circuit, a second input for receiving the power supply voltage VDD, a third input for receiving the first middle voltage VM1, and an output for outputting a first data signal, and a second output stage with a negative polarity having a first input electrically coupled to the output of the first analog circuit and the output of the second analog circuit through a switch S22 of the second pair of switches S21 and S22 for receiving the first amplified signal from the first analog circuit or the second amplified signal from the second analog circuit, a second input for receiving the second middle voltage VM2, a third input for receiving the ground voltage GND, and an output for outputting a second data signal. In one embodiment, the first and second data signals have positive and negative polarities, respectively.

Each odd data line of the plurality of data line are electrically coupled to the output of the first output stage and the output of the second output stage through a switch S31 of the third pair of switches S31 and S32 for receiving the first data signal from the first output stage or the second data signal from the second output stage. Each even data line of the plurality of data line are electrically coupled to the output of the first output stage and the output of the second output stage through a switch S32 of the third pair of switches S31 and S32 for receiving the first data signal from the first output stage or the second data signal from the second output stage. The third pair of switches S31 and S32 is configured such that each odd data line of the plurality of data line receives one of the first and second data signals, while each even data line of the plurality of data line receives the other of the first and second data signals, and vice versa.

In one embodiment, the control signal POL has a low state and a high state, wherein when the control signal POL is in the high state, each odd data line of the plurality of data line receives the first data signal, while each even data line of the plurality of data line receives the second data signal, and wherein when the control signal POL is in the low state, each odd data line of the plurality of data line receives the second data signal, while each even data line of the plurality of data line receives the first data signal.

In one embodiment, each of the first middle voltage VM1 and the second middle voltage VM2 is less than the power supply voltage VDD and greater than the ground voltage GND. The first middle voltage VM1 and the second middle voltage VM2 are identical to or different from each other. Each of the first middle voltage VM1 and the second middle voltage VM2 is equal to or less than a half of the power supply voltage VDD.

In one embodiment, the first analog circuit and the first output stage constitute a first operational amplifier, and the second analog circuit and the second output stage constitute a second operational amplifier.

In another aspect, the present invention relates to a method for driving a display having a plurality of pixels spatially arranged in a matrix form, and a plurality of data lines, each data line being associated with pixels of a corresponding pixel column. In one embodiment, the method includes the steps of providing a power supply voltage, VDD, a ground voltage, GND, a first middle voltage, VM1, a second middle voltage, VM2, and a control signal, POL, having a low state and a high state, and providing a source driver.

In one embodiment, the source driver includes a first pair of switches, S11 and S12, a second pair of switches, S21 and S22, and a third pair of switches, S31 and S32, controlled by a control signal, POL. The source driver also includes a first level shifter having a first input for receiving an input data, a second input for receiving a power supply voltage, VDD, a third input for receiving a first middle voltage, VM1, and an output for outputting a first level-shifted signal of the input data, and a second level shifter having a first input for receiving the input data, a second input for receiving a second middle voltage, VM2, a third input for receiving a ground voltage, GND, and an output for outputting a second level-shifted signal of the input data.

Furthermore, the source driver includes a first digital-to-analog converter with a positive polarity (PDAC) having a first input electrically coupled to the output of the first level shifter for receiving the first level-shifted signal therefrom, a second input for receiving the power supply voltage VDD, a third input for receiving the first middle voltage VM1, a fourth input for receiving a Gamma voltage, and an output for outputting a first converted signal, and a second digital-to-analog converter with a negative polarity (NDAC) having a first input electrically coupled to the output of the second level shifter for receiving the second level-shifted signal therefrom, a second input for receiving the second middle voltage VM2, a third input for receiving the ground voltage GND, a fourth input for receiving the Gamma voltage, and an output for outputting a second converted signal. In one embodiment, the first and second converted signals have positive and negative polarities, respectively.

Moreover, the source driver includes a first analog circuit having a first input electrically coupled to the output of the PDAC and the output of the NDAC through a switch S11 of the first pair of switches S11 and S12 for receiving the first converted signal from the PDAC or the second converted signal from the NDAC, a second input for receiving the power supply voltage VDD, a third input for receiving the ground voltage GND, and an output for outputting a first amplified signal, and a second analog circuit having a first input electrically coupled to the output of the PDAC and the output of the NDAC through a switch S12 of the first pair of switches S11 and S12 for receiving the first converted signal from the PDAC or the second converted signal from the NDAC, a second input for receiving the power supply voltage VDD, a third input for receiving the ground voltage GND, and an output for outputting a second amplified signal. In one embodiment, the first analog circuit and the second analog circuit are identical to or different from each other.

Additionally, the source driver includes a first output stage with a positive polarity having a first input electrically coupled to the output of the first analog circuit and the output of the second analog circuit through a switch S21 of the second pair of switches S21 and S22 for receiving the first amplified signal from the first analog circuit or the second amplified signal from the second analog circuit, a second input for receiving the power supply voltage VDD, a third input for receiving the first middle voltage VM1, and an output for outputting a first data signal, and a second output stage with a negative polarity having a first input electrically coupled to the output of the first analog circuit and the output of the second analog circuit through a switch S22 of the second pair of switches S21 and S22 for receiving the first amplified signal from the first analog circuit or the second amplified signal from the second analog circuit, a second input for receiving the second middle voltage VM2, a third input for receiving the ground voltage GND, and an output for outputting a second data signal. In one embodiment, the first and second data signals have positive and negative polarities, respectively.

Each odd data line of the plurality of data line are electrically coupled to the output of the first output stage and the output of the second output stage through a switch S31 of the third pair of switches S31 and S32 for receiving the first data signal from the first output stage or the second data signal from the second output stage. Each even data line of the plurality of data line are electrically coupled to the output of the first output stage and the output of the second output stage through a switch S32 of the third pair of switches S31 and S32 for receiving the first data signal from the first output stage or the second data signal from the second output stage. The third pair of switches S31 and S32 is configured such that each odd data line of the plurality of data line receives one of the first and second data signals, while each even data line of the plurality of data line receives the other of the first and second data signals, and vice versa.

When the control signal POL is in the high state, each odd data line of the plurality of data line receives the first data signal, while each even data line of the plurality of data line receives the second data signal, and wherein when the control signal POL is in the low state, each odd data line of the plurality of data line receives the second data signal, while each even data line of the plurality of data line receives the first data signal.

In yet another aspect, the present invention relates to a source driver for driving a display having a plurality of pixels spatially arranged in a matrix form, and a plurality of data lines, each data line being associated with pixels of a corresponding pixel column.

In one embodiment, the source driver has a first pair of switches, S11 and S12, a second pair of switches, S21 and S22, and a third pair of switches, S31 and S32, controlled by a control signal, POL, a first digital-to-analog converter with a positive polarity (PDAC) having an output for outputting a first converted signal having a positive polarity, a second digital-to-analog converter with a negative polarity (NDAC) having an output for outputting a second converted signal having a negative polarity. The source driver also has a first operational amplifier and a second operational amplifier.

In one embodiment, the first operational amplifier includes a 1st & 2nd stage having a first input electrically coupled to the output of the PDAC and the output of the NDAC through a switch S11 of the first pair of switches S11 and S12 for receiving the first converted signal from the PDAC or the second converted signal from the NDAC, a second input for receiving the power supply voltage VDD, a third input for receiving the ground voltage GND, and an output for outputting a first amplified signal, and an output stage having a first input, a second input for receiving the power supply voltage VDD, a third input for receiving the first middle voltage VM1, and an output for outputting a first data signal.

The second operational amplifier includes a 1st & 2nd stage having a first input electrically coupled to the output of the PDAC and the output of the NDAC through a switch S12 of the first pair of switches S11 and S12 for receiving the first converted signal from the PDAC or the second converted signal from the NDAC, a second input for receiving the power supply voltage VDD, a third input for receiving the ground voltage GND, and an output for outputting a second amplified signal, and an output stage having a first input, a second input for receiving the power supply voltage VDD, a third input for receiving the first middle voltage VM1, and an output for outputting a first data signal.

The first input of the output stage of the first operational amplifier is electrically coupled to the output of the 1st & 2nd stage of the first operational amplifier and the output of the 1st & 2nd stage of the second operational amplifier through a switch S21 of the second pair of switches S21 and S22 for receiving the first amplified signal from the 1st & 2nd stage of the first operational amplifier or the second amplified signal from the 1st & 2nd stage of the second operational amplifier.

The first input of the output stage of the second operational amplifier is electrically coupled to the output of the 1st & 2nd stage of the first operational amplifier and the output of the 1st & 2nd stage of the second operational amplifier through a switch S22 of the second pair of switches S21 and S22 for receiving the first amplified signal from the 1st & 2nd stage of the first operational amplifier or the second amplified signal from the 1st & 2nd stage of the second operational amplifier.

Additionally, each odd data line of the plurality of data line are electrically coupled to the output of the output stage of the first operational amplifier and the output of the output stage of the second operational amplifier through a switch S31 of the third pair of switches S31 and S32 for receiving the first data signal from the output stage of the first operational amplifier or the second data signal from the output stage of the second operational amplifier. Each even data line of the plurality of data line are electrically coupled to the output of the output stage of the first operational amplifier and the output of the output stage of the second operational amplifier through a switch S32 of the third pair of switches S31 and S32 for receiving the first data signal from the output stage of the first operational amplifier or the second data signal from the output stage of the second operational amplifier.

The third pair of switches S31 and S32 is configured such that each odd data line of the plurality of data line receives one of the first and second data signals, while each even data line of the plurality of data line receives the other of the first and second data signals, and vice versa.

Furthermore, the source driver may have a first level shifter having a first input for receiving an input data, a second input for receiving the power supply voltage VDD, a third input for receiving the first middle voltage VM1, and an output for outputting a first level-shifted signal of the input data, and a second level shifter having a first input for receiving the input data, a second input for receiving the second middle voltage VM2, a third input for receiving the ground voltage GND, and an output for outputting a second level-shifted signal of the input data.

Additionally, the PDAC further comprises a first input electrically coupled to the output of the first level shifter for receiving the first level-shifted signal therefrom, a second input for receiving the power supply voltage VDD, a third input for receiving the first middle voltage VM1, a fourth input for receiving a Gamma voltage. The NDAC further comprises a first input electrically coupled to the output of the second level shifter for receiving the second level-shifted signal therefrom, a second input for receiving the second middle voltage VM2, a third input for receiving the ground voltage GND, a fourth input for receiving the Gamma voltage, and an output for outputting a second converted signal having a negative polarity.

In one embodiment, the first and second converted signals have positive and negative polarities, respectively. The first and second data signals have positive and negative polarities, respectively.

In one embodiment, the control signal POL has a low state and a high state, wherein when the control signal POL is in the high state, each odd data line of the plurality of data line receives the first data signal, while each even data line of the plurality of data line receives the second data signal, and wherein when the control signal POL is in the low state, each odd data line of the plurality of data line receives the second data signal, while each even data line of the plurality of data line receives the first data signal.

In one embodiment, each of the first middle voltage VM1 and the second middle voltage VM2 is less than the power supply voltage VDD and greater than the ground voltage GND. The first middle voltage VM1 and the second middle voltage VM2 are identical to or different from each other. Each of the first middle voltage VM1 and the second middle voltage VM2 is equal to or less than a half of the power supply voltage VDD.

In a further aspect, the present invention relates to a method for driving a display having a plurality of pixels spatially arranged in a matrix form, and a plurality of data lines, each data line being associated with pixels of a corresponding pixel column. In one embodiment, the method includes the steps of providing a power supply voltage, VDD, a ground voltage, GND, a first middle voltage, VM1, a second middle voltage, VM2, and a control signal, POL, having a low state and a high state, and providing a source driver.

In one embodiment, the source driver has a first pair of switches, S11 and S12, a second pair of switches, S21 and S22, and a third pair of switches, S31 and S32, controlled by a control signal, POL, a first digital-to-analog converter with a positive polarity (PDAC) having an output for outputting a first converted signal having a positive polarity, a second digital-to-analog converter with a negative polarity (NDAC) having an output for outputting a second converted signal having a negative polarity.

The source driver also has a first operational amplifier and a second operational amplifier. In one embodiment, the first operational amplifier includes a 1st & 2nd stage having a first input electrically coupled to the output of the PDAC and the output of the NDAC through a switch S11 of the first pair of switches S11 and S12 for receiving the first converted signal from the PDAC or the second converted signal from the NDAC, a second input for receiving the power supply voltage VDD, a third input for receiving the ground voltage GND, and an output for outputting a first amplified signal, and an output stage having a first input, a second input for receiving the power supply voltage VDD, a third input for receiving the first middle voltage VM1, and an output for outputting a first data signal.

The second operational amplifier includes a 1st & 2nd stage having a first input electrically coupled to the output of the PDAC and the output of the NDAC through a switch S12 of the first pair of switches S11 and S12 for receiving the first converted signal from the PDAC or the second converted signal from the NDAC, a second input for receiving the power supply voltage VDD, a third input for receiving the ground voltage GND, and an output for outputting a second amplified signal, and an output stage having a first input, a second input for receiving the second middle voltage VM2, a third input for receiving the ground voltage GND, and an output for outputting a second data signal.

The first input of the output stage of the first operational amplifier is electrically coupled to the output of the 1st & 2nd stage of the first operational amplifier and the output of the 1st & 2nd stage of the second operational amplifier through a switch S21 of the second pair of switches S21 and S22 for receiving the first amplified signal from the 1st & 2nd stage of the first operational amplifier or the second amplified signal from the 1st & 2nd stage of the second operational amplifier. The first input of the output stage of the second operational amplifier is electrically coupled to the output of the 1st & 2nd stage of the first operational amplifier and the output of the 1st & 2nd stage of the second operational amplifier through a switch S22 of the second pair of switches S21 and S22 for receiving the first amplified signal from the 1st & 2nd stage of the first operational amplifier or the second amplified signal from the 1st & 2nd stage of the second operational amplifier.

Additionally, each odd data line of the plurality of data line are electrically coupled to the output of the output stage of the first operational amplifier and the output of the output stage of the second operational amplifier through a switch S31 of the third pair of switches S31 and S32 for receiving the first data signal from the output stage of the first operational amplifier or the second data signal from the output stage of the second operational amplifier. Each even data line of the plurality of data line are electrically coupled to the output of the output stage of the first operational amplifier and the output of the output stage of the second operational amplifier through a switch S32 of the third pair of switches S31 and S32 for receiving the first data signal from the output stage of the first operational amplifier or the second data signal from the output stage of the second operational amplifier. The third pair of switches S31 and S32 is configured such that each odd data line of the plurality of data line receives one of the first and second data signals, while each even data line of the plurality of data line receives the other of the first and second data signals, and vice versa.

When the control signal POL is in the high state, each odd data line of the plurality of data line receives the first data signal, while each even data line of the plurality of data line receives the second data signal, and wherein when the control signal POL is in the low state, each odd data line of the plurality of data line receives the second data signal, while each even data line of the plurality of data line receives the first data signal.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein:

FIG. 5 shows exemplary results of the power consumptions and operation temperatures of an LCD module under a conventionally full voltage driving configuration and the half voltage driving configuration according to embodiment of the present invention;

DETAILED DESCRIPTION OF THE INVENTION

Figure 1:
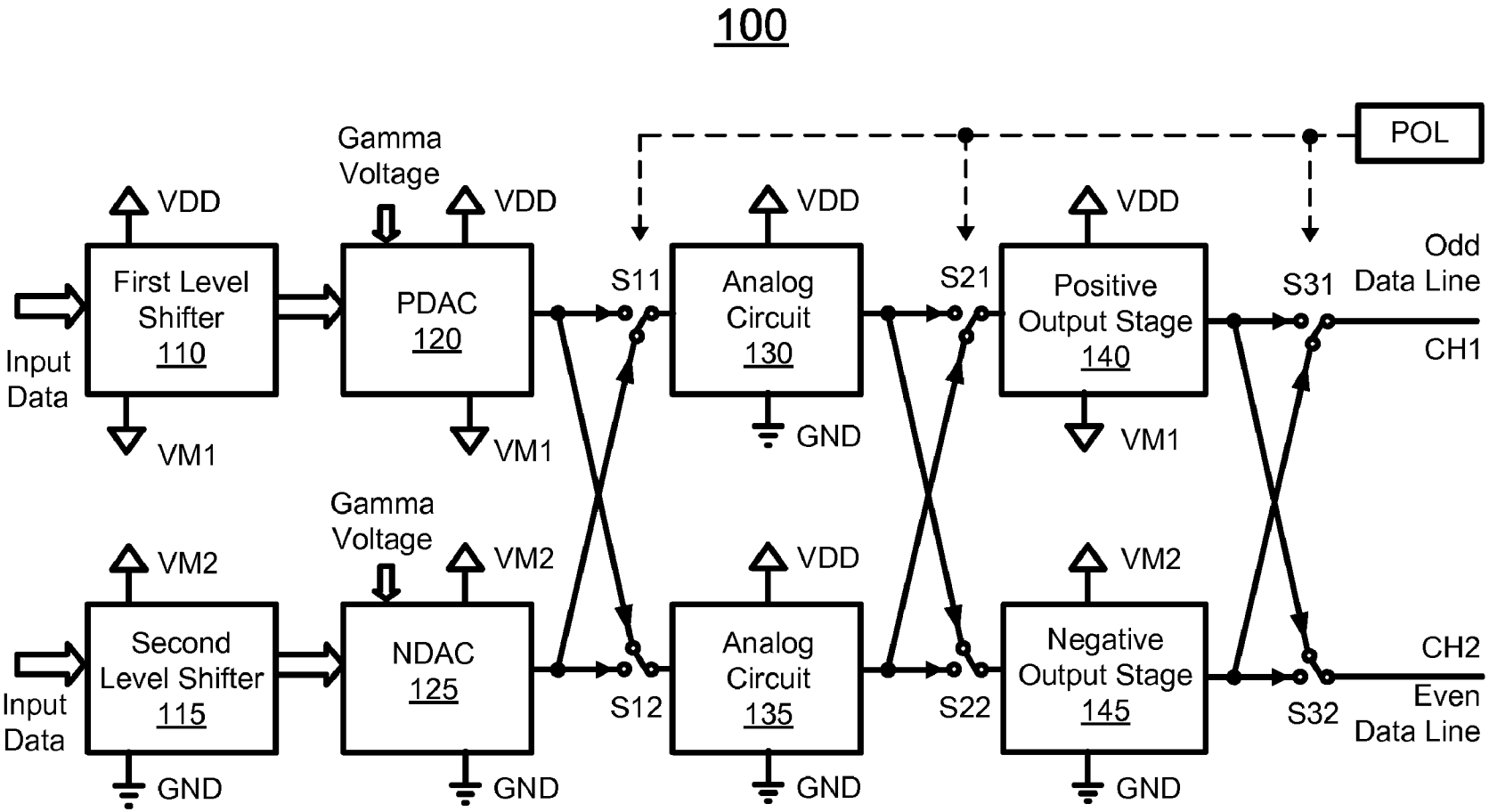
FIG. 1 shows schematically a block diagram of a source driver according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. The use of examples anywhere in this specification, including examples of any terms discussed herein, is illustrative only, and in no way limits the scope and meaning of the invention or of any exemplified term. Likewise, the invention is not limited to various embodiments given in this specification.

As used herein, the terms "comprising," "including," "having," "containing," "involving," and the like are to be understood to be open-ended, i.e., to mean including but not limited to.

The description will be made as to the embodiments of the present invention in conjunction with the accompanying drawings of FIGS. 1-7. In accordance with the purposes of this invention, as embodied and broadly described herein, this invention, in one aspect, relates to a source driver for driving a display having a plurality of pixels spatially arranged in a matrix form, and a plurality of data lines, where each data line is associated with pixels of a corresponding pixel column.

Referring to FIG. 1, a source driver 100 is shown according to one embodiment of the present invention. The source driver 100 includes a first level shifter 110 and a second level shifter 115 for receiving digital image data and shifting a voltage level of the digital image data, a first digital-to-analog converter with a positive polarity (PDAC) 120 and a second first digital-to-analog converter with a negative polarity (NDAC) 125 for converting the level-shifted digital image data into analog signals, a first analog circuit 130 and a second analog circuit 135 for comparing and amplifying the analog signals, and a first output stage 140 with a positive polarity and a second output stage 145 with a negative polarity for outputting the amplified analog signals with desired polarities to the plurality of data lines so as to drive the plurality of pixels.

According to the present invention, the PDAC 120 and the NDAC 125 electrically coupled to the first analog circuit 130 and the second analog circuit 135 through a first pair of switches, S11 and S12; the first analog circuit 130 and the second analog circuit 135 electrically coupled to the first output stage 140 and the second output stage 145 through a second pair of switches, S21 and S22; and the first output stage 140 and the second output stage 145 electrically coupled to odd data lines and even data lines through a third pair of switches, S31 and S32, respectively. The first pair of switches, S11 and S12, the second pair of switches, S21 and S22, and the third pair of switches, S31 and S32, are controlled by a control signal, POL, having a low state (e.g., POL=0) and a high state (e.g., POL=1).

As shown in FIG. 1, the first level shifter 110 has a first input for receiving a digital input data of an image to be displayed, a second input for receiving a power supply voltage, VDD, a third input for receiving a first middle voltage, VM1, and an output for outputting a first level-shifted signal of the input data to the PDAC 120. Similarly, the second level shifter 115 has a first input for receiving the input data, a second input for receiving a second middle voltage, VM2, a third input for receiving a ground voltage, GND, and an output for outputting a second level-shifted signal of the input data to the NDAC 125.

Each of the first middle voltage VM1 and the second middle voltage VM2 are less than the power supply voltage VDD and greater than the ground voltage GND, where GND is usually set to 0V. The first middle voltage VM1 and the second middle voltage VM2 are identical to or different from each other. Further, each of the first middle voltage VM1 and the second middle voltage VM2 is equal to or less than a half of the power supply voltage VDD. The power supply voltage, VDD, the first middle voltage VM1 and the second middle voltage VM2 are provided by one or more power supplies. According to one embodiment of the present invention, the middle voltages are set as follows: If the middle voltages are supplied from a single power source, i.e., if the first middle voltage VM1 and the second middle voltage VM2 are the same, the first middle voltage and the second middle voltage VM1=VM2 can be set as VDD/2. When there are two or more power sources, i.e., when VM1≠VM2, the first middle voltage level VM1 is set to larger than the ground voltage GND and smaller than or equal to VDD/2, and the second middle voltage VM2 is larger than or equal to VDD/2 and is smaller than the power supply voltage VDD.

The PDAC 120 has a first input electrically coupled to the output of the first level shifter 110 for receiving the first level-shifted signal therefrom, a second input for receiving the power supply voltage VDD, a third input for receiving the first middle voltage VM1, a fourth input for receiving a Gamma voltage, and an output for outputting a first converted signal having a positive polarity. The NDAC 125 has a first input electrically coupled to the output of the second level shifter 115 for receiving the second level-shifted signal therefrom, a second input for receiving the second middle voltage VM2, a third input for receiving the ground voltage GND, a fourth input for receiving the Gamma voltage, and an output for outputting a second converted signal having a negative polarity. The Gamma voltage is adapted for Gamma correction of the display, and provided by a Gamma voltage generator or the like. The first converted signal output from the PDAC 120 and the second converted signal output from the NDAC 125 are analog data corresponding to the digital input data of the image to be displayed. Each of the first and second converted signals is output to the first analog circuit 130 or the second analog circuit 135, depending upon the control signal POL. For example, if POL=0, the first converted signal is provided to the first analog circuit 130, and the second converted signal is provided to the second analog circuit 135. However, if POL=1, the first converted signal is provided to the second analog circuit 135, while the second converted signal is provided to the first analog circuit 130.

The first analog circuit 130 has a first input electrically coupled to the output of the PDAC 120 and the output of the NDAC 125 through a switch S11 of the first pair of switches S11 and S12 for receiving the first converted signal from the PDAC 120 or the second converted signal from the NDAC 125, a second input for receiving the power supply voltage VDD, a third input for receiving the ground voltage GND, and an output for outputting a first amplified signal. The second analog circuit 135 has a first input electrically coupled to the output of the PDAC 120 and the output of the NDAC 125 through a switch S12 of the first pair of switches S11 and S12 for receiving the first converted signal from the PDAC 120 or the second converted signal from the NDAC 125, a second input for receiving the power supply voltage VDD, a third input for receiving the ground voltage GND, and an output for outputting a second amplified signal. Each of the first and second amplified signals is provided to the first output stage 140 or the second output stage 145, depending upon the control signal POL. For example, if POL=0, the first amplified signal is provided to the first output stage 140, and the second amplified signal is provided to the second output stage 145. However, if POL=1, the first amplified signal is provided to the second output stage 145, and the second amplified signal is provided to the first output stage 140.

The first analog circuit and the second analog circuit are identical to or different from each other. Preferably, the first analog circuit and the second analog circuit are identical.

The first output stage 140 with a positive polarity has a first input electrically coupled to the output of the first analog circuit 130 and the output of the second analog circuit 135 through a switch S21 of the second pair of switches S21 and S22 for receiving the first amplified signal from the first analog circuit 130 or the second amplified signal from the second analog circuit 135, a second input for receiving the power supply voltage VDD, a third input for receiving the first middle voltage VM1, and an output for outputting a first data signal. The second output stage 145 with a negative polarity having a first input electrically coupled to the output of the first analog circuit 130 and the output of the second analog circuit 135 through a switch S22 of the second pair of switches S21 and S22 for receiving the first amplified signal from the first analog circuit 130 or the second amplified signal from the second analog circuit 135, a second input for receiving the second middle voltage VM2, a third input for receiving the ground voltage GND, and an output for outputting a second data signal. The first and second data signals have positive and negative polarities, respectively.

Additionally, the output of the first output stage 140 and the output of the second output stage 145 are electrically coupled to odd data lines and even data lines through a switch S31 of the third pair of switches S31 and S32 that is controlled by the control signal POL. If POL=0, the first data signal is provided to the odd data lines, while the second data signal is provided to the even data lines. If POL=1, the first data signal is provided to the even data lines, while the second data signal is provided to the odd data lines. In other words, when the control signal POL is in the high state, each odd data line of the plurality of data line receives the first data signal having the positive polarity, while each even data line of the plurality of data line receives the second data signal having the negative polarity. When the control signal POL is in the low state, each odd data line of the plurality of data line receives the second data signal having the negative polarity, while each even data line of the plurality of data line receives the first data signal having the positive polarity.

In this exemplary embodiment, the first analog circuit 130 and the first output stage 140 constitute a first operational amplifier, and the second analog circuit 135 and the second output stage 145 constitute a second operational amplifier.

According to the present invention, as described above, the power source for all the first level shifter 110, the PDAC 120, and the first output stage 140 is between the power supply voltage level VDD and the first middle voltage level VM1, and the power source for all the second level shifter 115, the NDAC 125 and the second output stage 145 between the second middle voltage level VM2 and the ground voltage GND. That is, the amplitude variations of the operational voltages for the first level shifter 110, the PDAC 120, and the first output stage 140 is about (VDD−VM1), and for the second level shifter 115, the NDAC 125 and the second output stage 145 is about (VM2−GND), which are much less than the amplitude variations of the conventionally operational voltages, (VDD−GND). As discussed below, for a driving configuration, the power consumption of the display and the temperature of the display panel could be reduced substantially.

Figure 2:
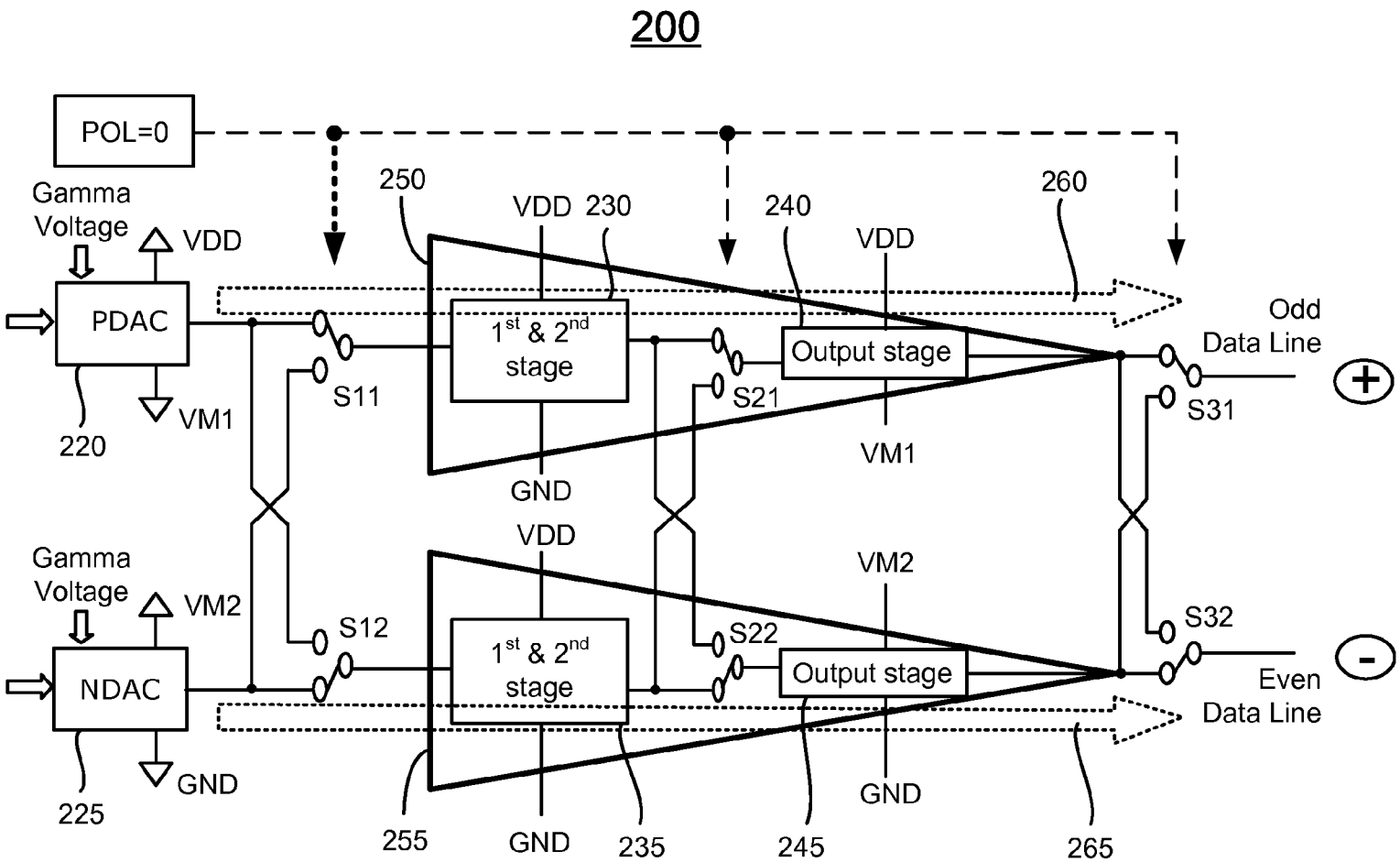
FIG. 2 shows schematically a block diagram of a source driver according to another embodiment of the present invention, where POL=0.
Figure 3:
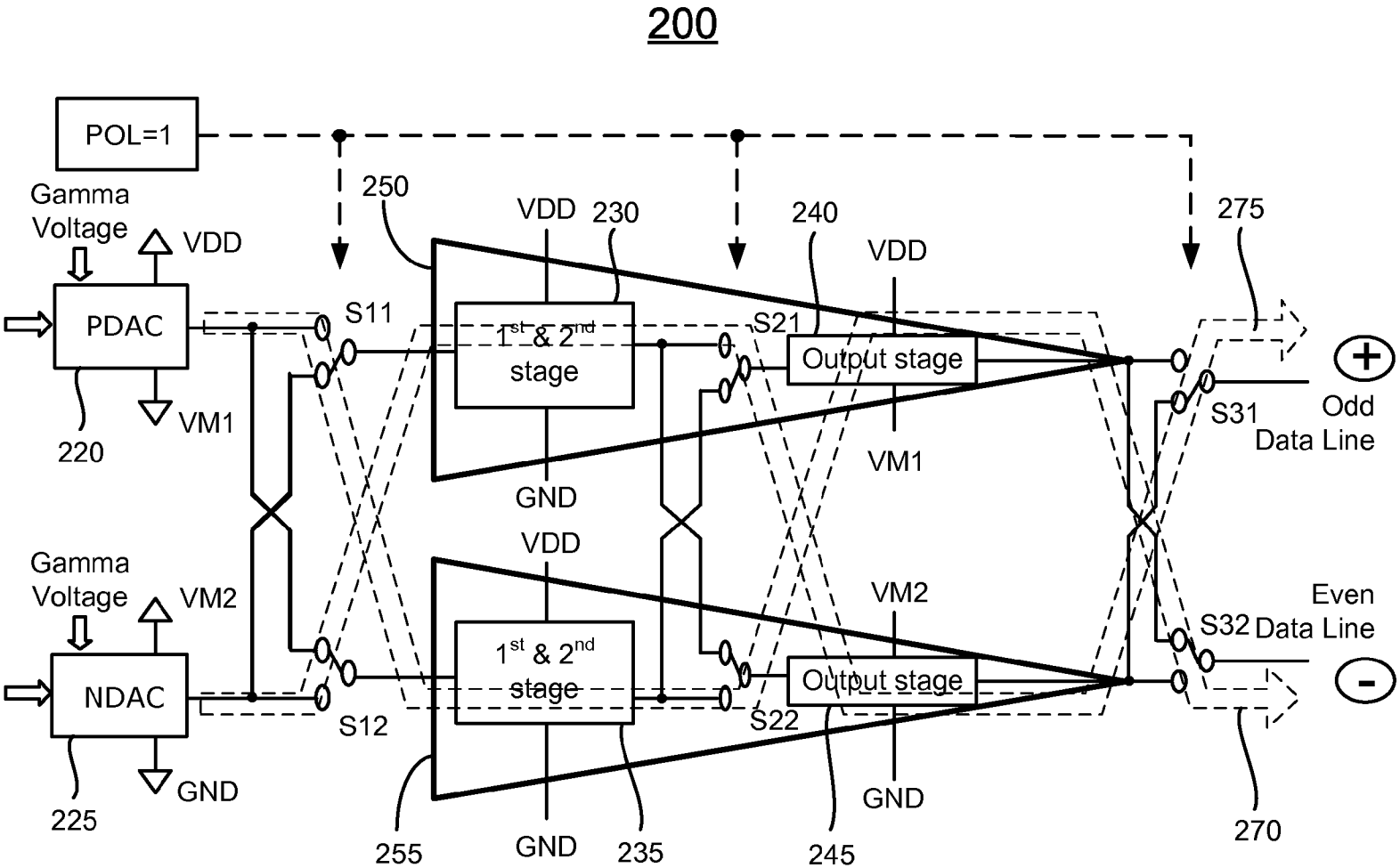
FIG. 3 shows schematically the block diagram of the source driver as shown in FIG. 2, where POL=1.

FIGS. 2 and 3 show a source driver 200 according to another embodiment of the present invention. The source driver 200 includes a first digital-to-analog converter with a positive polarity (PDAC) 220 having an output for outputting a first converted signal having a positive polarity, a second digital-to-analog converter with a negative polarity (NDAC) 225 having an output for outputting a second converted signal having a negative polarity, a first operational amplifier 250 and a second operational amplifier 255.

The first operational amplifier 250 includes a 1st & 2nd stage 230 an output stage 240. The 1st & 2nd stage 230 has a first input electrically coupled to the output of the PDAC 220 and the output of the NDAC 225 through a switch S11 of the first pair of switches S11 and S12 for receiving the first converted signal from the PDAC 220 or the second converted signal from the NDAC 225, a second input for receiving the power supply voltage VDD, a third input for receiving the ground voltage GND, and an output for outputting a first amplified signal. The output stage 240 has a first input, a second input for receiving the power supply voltage VDD, a third input for receiving the first middle voltage VM1, and an output for outputting a first data signal having a positive polarity.

The second operational amplifier 255 includes a 1st & 2nd stage 235 having a first input electrically coupled to the output of the PDAC 220 and the output of the NDAC 225 through a switch S21 of the first pair of switches S11 and S12 for receiving the first converted signal from the PDAC 220 or the second converted signal from the NDAC 225, a second input for receiving the power supply voltage VDD, a third input for receiving the ground voltage GND, and an output for outputting a second amplified signal, and an output stage 245 having a first input, a second input for receiving the power supply voltage VM2, a third input for receiving the ground voltage GND, and an output for outputting a second data signal having a negative polarity.

The first input of the output stage 240 of the first operational amplifier 250 is electrically coupled to the output of the 1st & 2nd stage 230 of the first operational amplifier 250 and the output of the 1st & 2nd stage 235 of the second operational amplifier 255 through a switch S21 of the second pair of switches S21 and S22 for receiving the first amplified signal from the 1st & 2nd stage 230 of the first operational amplifier 250 or the second amplified signal from the 1st & 2nd stage 235 of the second operational amplifier 255. The first input of the output stage 245 of the second operational amplifier 255 is electrically coupled to the output of the 1st & 2nd stage 230 of the first operational amplifier 250 and the output of the 1st & 2nd stage 235 of the second operational amplifier 255 through a switch S22 of the second pair of switches S21 and S22 for receiving the first amplified signal from the 1st & 2nd stage 230 of the first operational amplifier 255 or the second amplified signal from the 1st & 2nd stage 235 of the second operational amplifier 255.

Additionally, each odd data line of the plurality of data line are electrically coupled to the output of the output stage 240 of the first operational amplifier 250 and the output of the output stage 245 of the second operational amplifier 255 through a switch S31 of the third pair of switches S31 and S32 for receiving the first data signal from the output stage 240 of the first operational amplifier 250 or the second data signal from the output stage 245 of the second operational amplifier 255. Each even data line of the plurality of data line are electrically coupled to the output of the output stage 240 of the first operational amplifier 250 and the output of the output stage 245 of the second operational amplifier 255 through a switch S32 of the third pair of switches S31 and S32 for receiving the first data signal from the output stage 240 of the first operational amplifier 250 or the second data signal from the output stage 245 of the second operational amplifier 255. The third pair of switches S31 and S32 is configured such that each odd data line of the plurality of data line receives one of the first and second data signals, while each even data line of the plurality of data line receives the other of the first and second data signals, and vice versa.

Furthermore, the source driver 200 may have a first level shifter coupled to the power supply voltage VDD and the first middle voltage VM1 for receiving digital input data of an image to be displayed, converting a voltage level of the digital image data, and outputting the first level-shifted signal to the PDAC 220. The source driver 200 may also have a second level shifter coupled to the ground voltage GND and the second middle voltage VM2, for receiving the digital input data of an image to be displayed, converting a voltage level of digital image data, and outputting the second level-shifted signal to the NDAC 225.

Additionally, the PDAC 220 may include a first input electrically coupled to the output of the first level shifter for receiving the first level-shifted signal therefrom, a second input for receiving the power supply voltage VDD, a third input for receiving the first middle voltage VM1, a fourth input for receiving a Gamma voltage. The NDAC 225 may also includes a first input electrically coupled to the output of the second level shifter for receiving the second level-shifted signal therefrom, a second input for receiving the second middle voltage VM2, a third input for receiving the ground voltage GND, a fourth input for receiving the Gamma voltage, and an output for outputting a second converted signal having a negative polarity.

In operation, the first pair of switches S11 and S12, the second pair of switches S21 and S22, and a third pair of switches S31 and S32 are controlled by the control signal POL having a low state (POL=0) and a high state (POL=1).

When the control signal POL is in the low state, as shown in FIG. 2, the first converted signal is output from the PDAC 220 to the 1st & 2nd stage 230 of the first operational amplifier 250; the first amplified signal is output from the 1st & 2nd stage 230 to the output stage 240 of the first operational amplifier 250; the first data signal is output from the output stage 240 of the first operational amplifier 250 to the odd data lines of the plurality of data lines. The signals are transmitted from the PDAC 220 to the odd data lines along a path 260. Further, the second converted signal is output from the NDAC 225 to the 1st & 2nd stage 235 of the second operational amplifier 255; the second amplified signal is output from the 1st & 2nd stage 235 to the output stage 245 of the second operational amplifier 255; the second data signal is output from the output stage 245 of the second operational amplifier 255 to the even data lines of the plurality of data lines. The signals are transmitted from the NDAC 225 to the even data lines along a path 260.

When the control signal POL is in the high state, as shown in FIG. 3, the first converted signal is output from the PDAC 220 to the 1st & 2nd stage 235 of the second operational amplifier 255; the second amplified signal is output from the 1st & 2nd stage 235 of the second operational amplifier 255 to the output stage 240 of the first operational amplifier 250; the first data signal is output from the output stage 240 of the first operational amplifier 250 to the even data lines of the plurality of data lines. The signals are transmitted from the PDAC 220 to the even data lines along a path 270. Further, the second converted signal is output from the NDAC 225 to the 1st & 2nd stage 230 of the first operational amplifier 250; the first amplified signal is output from the 1st & 2nd stage 230 of the first operational amplifier 250 to the output stage 245 of the second operational amplifier 255; the second data signal is output from the output stage 245 of the second operational amplifier 255 to the odd data lines of the plurality of data lines. The signals are transmitted from the NDAC 225 to the odd data lines along a path 275

Figure 4:
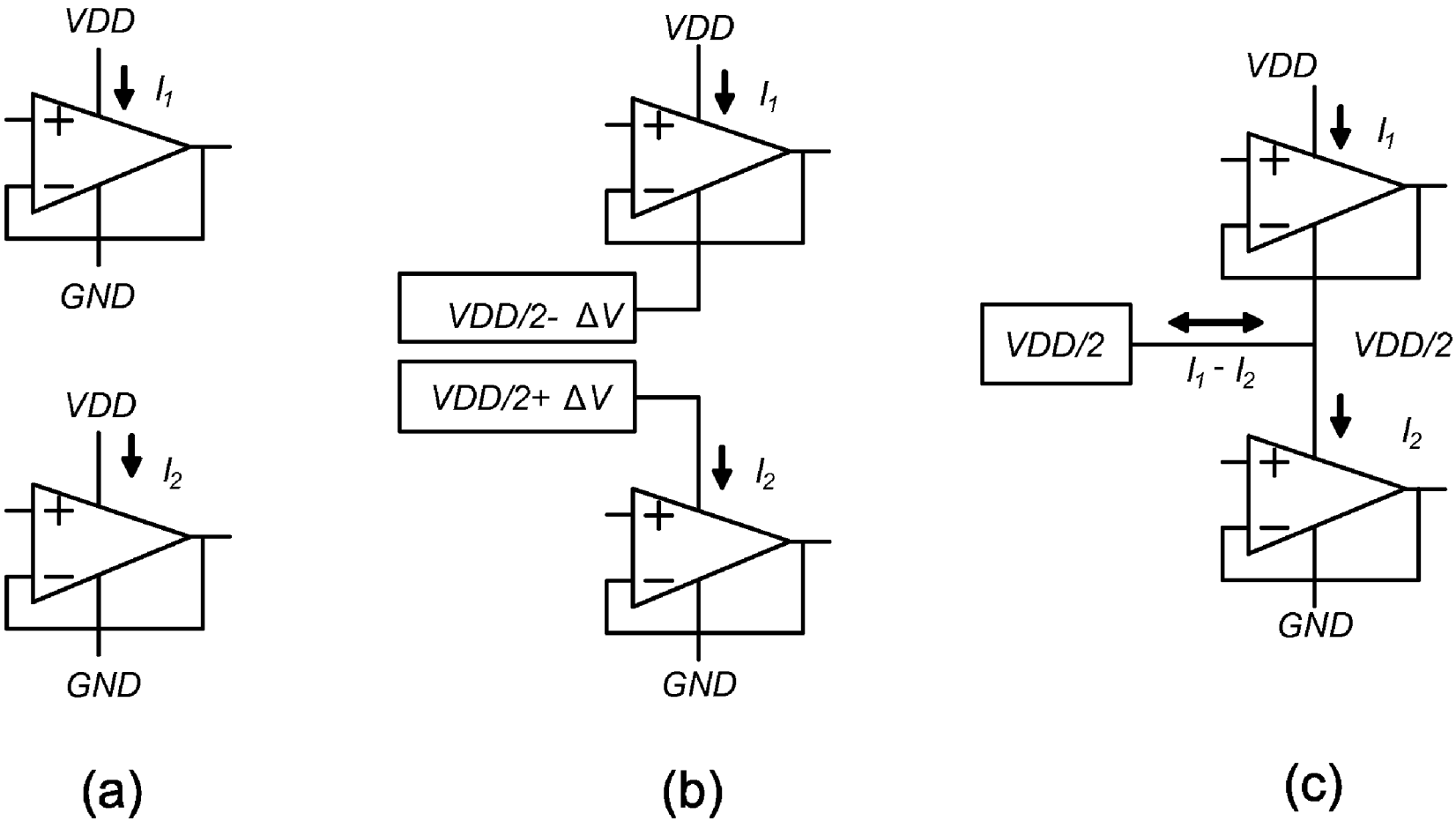
FIG. 4 shows schematically configurations of a source driver: (a) a conventionally full voltage driving configuration, (b) an half voltage driving configuration with the first middle voltage VM1=(VDD/2−ΔV) and the second middle voltage VM2=(VDD/2+ΔV) according to one embodiment of the present invention, and (c) an half voltage driving configuration with the first middle voltage VM1=VDD/2, and the second middle voltage VM2=VDD/2 according to another embodiment of the present invention.

FIG. 4 shows various configurations of a source driver: (a) a conventionally full voltage driving configuration, (b) an half voltage driving configuration with the first middle voltage VM1=(VDD/2−ΔV) and the second middle voltage VM2=(VDD/2+ΔV) according to one embodiment of the present invention, and (c) an half voltage driving configuration with the first middle voltage VM1=VDD/2, and the second middle voltage VM2=VDD/2 according to another embodiment of the present invention. VDD and GND are the power supply voltage and the ground voltage, respectively. $I_1$ and $I_2$ are respectively the current flowed through the power supply to the first operational amplifier and through the second middle voltage supply to the second operational amplifier.

Accordingly, the power consumption of the source driver shown in FIG. 4(*a*) is about $$P_{IC\text{-}1} VDD \times (I_1+I_2).$$

And its system power consumption is in the form of $$P_{SYS\text{-}1} = VDD \times (I_1+I_2),$$

which is same as the power consumption of the source driver.

The power consumption of the source driver shown in FIG. 4(*b*) is about $$P_{IC\text{-}2} = (VDD/2-\Delta V) \times I_1 + (VDD/2+\Delta V) \times I_2 \approx P_{IC\text{-}1}/2.$$

The power consumption of the source driver shown in FIG. 4(*b*) is approximately an half of that of the conventional source driver shown in FIG. 4(*a*). The system power consumption for the configuration of FIG. 4(*b*) is in the form of $$P_{SYS\text{-}2} = VDD \times (I_1+I_2) \times (1+\alpha), (\alpha>0).$$

The system power consumption $P_{SYS\text{-}2}$ increases in the configuration of FIG. 4(*b*).

For the source driver shown in FIG. 4(*c*), the power consumption is obtained by $$P_{IC\text{-}3} = (VDD/2-\Delta V) \times I_1 + (VDD/2+\Delta V) \times I_2 \approx P_{IC\text{-}1}/2.$$

The power consumption of the source driver shown in FIG. 4(*c*) is approximately an half of that of the conventional source driver shown in FIG. 4(*a*). The system power consumption for the configuration of FIG. 4(*c*) is in the form of $$P_{SYS\text{-}3} = VDD \times I_1 \approx P_{SYS\text{-}2}/2.$$

The total power consumption $P_{SYS\text{-}3}$ is approximately an half of the total power consumption $P_{SYS\text{-}2}$ of the source driver shown in FIG. 4(*b*).

Accordingly, the operation temperature can also reduced significantly for the half voltage driving configuration of the source driver of the present invention. FIG. 5 lists exemplary results of the power consumptions and operation temperatures of an LCD module under a conventionally full voltage driving configuration (Full-AVDD) and the half voltage driving configuration (Half-AVDD) according to embodiment of the present invention for various power consumption check patterns, such as white, black, sub-V-stripe, H-stripe and sub-checker, and different frame rates, such as 60 Hz, as shown in FIG. 5(*a*), and 120 Hz, as shown in FIG. 5(*b*). It is clearly shown that for all these power consumption check patterns with different frame rates, the power consumptions and operation temperatures of the LCD panel under the half voltage driving configuration (Half-AVDD) of the present invention are reduced substantially, comparing those under the conventionally full voltage driving configuration (Full-AVDD). Further, the reductions of the power consumptions and operation temperatures are the most significant for the H-stripe pattern with a higher frame rate. For example, according to the present invention, 31.38% of the power consumption and 37.39° C. of the operation temperature are reduced for the frame rate of 60 Hz, while 33.66% of the power consumption and 70.33° C. of the operation temperature are reduced for the frame rate of 120 Hz.

Additionally, according to the half voltage driving configuration of the present invention, the deviation of the pixel driving voltages is also minimized, so that no V-line mura and/or flickers occur when an image is displayed in the display. Furthermore, no chopper and YDIO signals are needed in driving the display.

For example, for a conventional source driver, a source data signal with a positive polarity applied to a channel (data line) is output from a first operational amplifier (OP1) with a positive polarity, while the source data signal with a negative polarity for the channel is output from a second operational amplifier (OP2) with a negative polarity. If the target driving voltages of a pixel, e.g., Pexil1, are about ±5 V, as shown in FIG. 6(*a*), ideally, the RMS (root-mean-square) brightness is averaged with the positive and negative polarities, which is:

$$\text{Brightness}=RMS(5V,-5V).$$

In fact, due to the manufacturing process, the outputs of the operational amplifiers may have voltage deviations from the input voltages. Provided that the output of the first operational amplifier (OP1) with the positive polarity has a voltage deviation of about +12 mV from the input target voltage, +5 V, and the output of the second operational amplifier (OP2) with the negative polarity has a voltage deviation of about −5 mV from the input target voltage, −5 V, as shown in FIG. 6(*b*), the actual RMS brightness in the channels is about $$\text{Brightness}=RMS(5.012V,-5.005V)=5V+8\text{ mV}.$$

Figure 6:
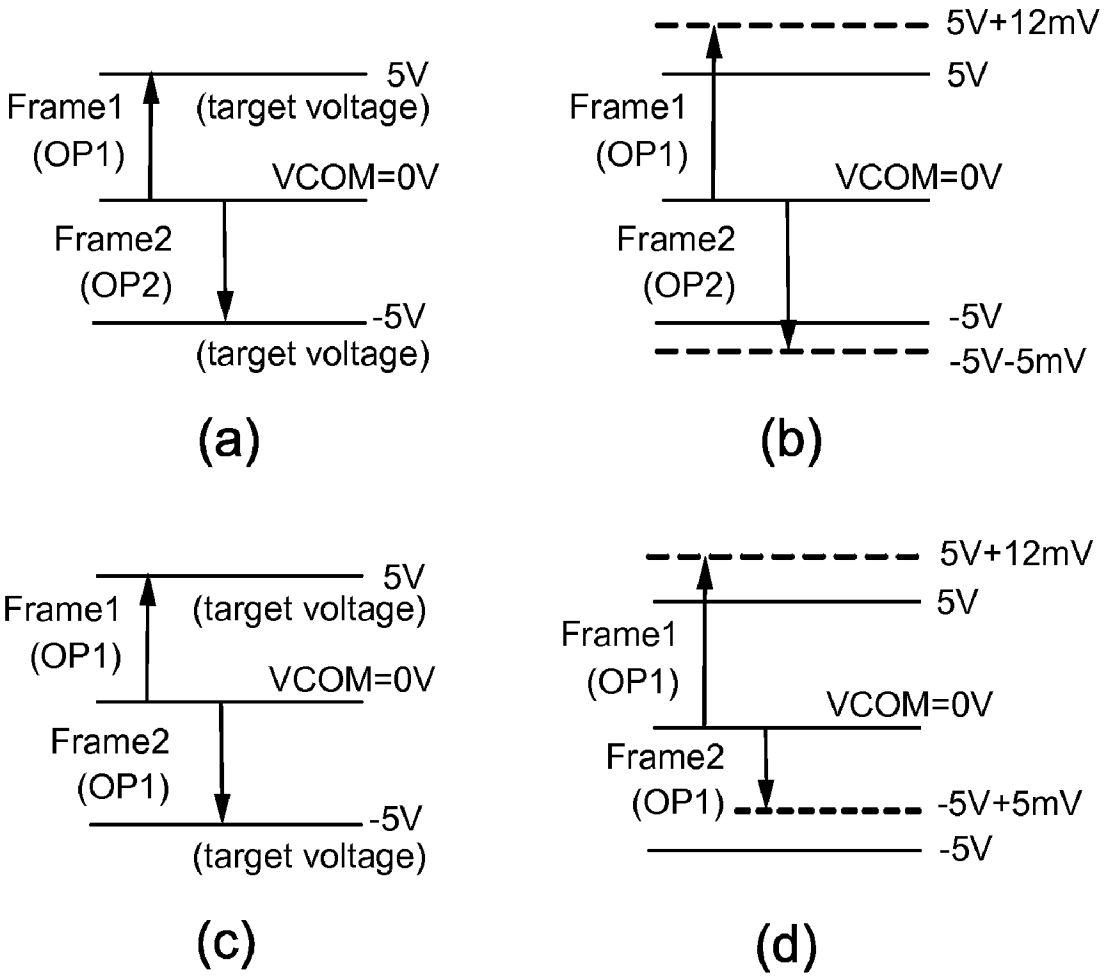
FIG. 6 shows deviations of the operation voltages of a conventional source driver (a) and (b), and of the source driver according to one embodiment of the present invention (c) and (d)

However, according to the present invention, the source data signal with the positive and negative polarities for the channel are always output from the first operational amplifier (OP1), as shown in FIG. 6(*d*). Accordingly, the RMS brightness in the channels is about $$\text{Brightness}=RMS(5.012V,-4.988V)=5V+0.014\text{ mV}.$$

Therefore, there are no bright and dark lines in the display according to the present invention.

Figure 7:
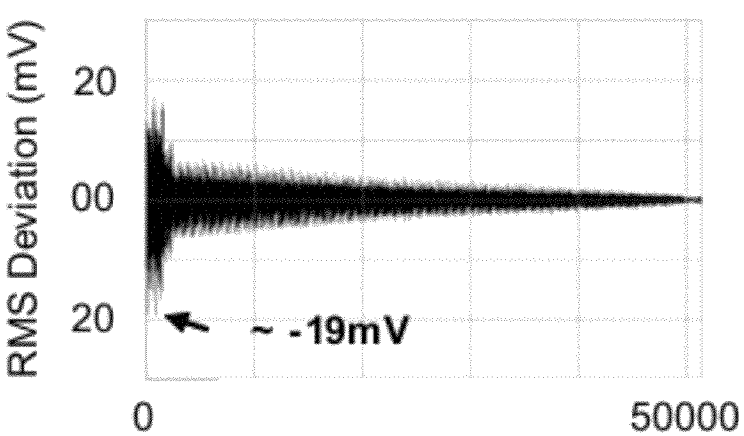
FIG. 7 shows experimental results of the RMS deviations of a conventional source driver (a) and of the source driver according to one embodiment of the present invention (b).
Figure 7:
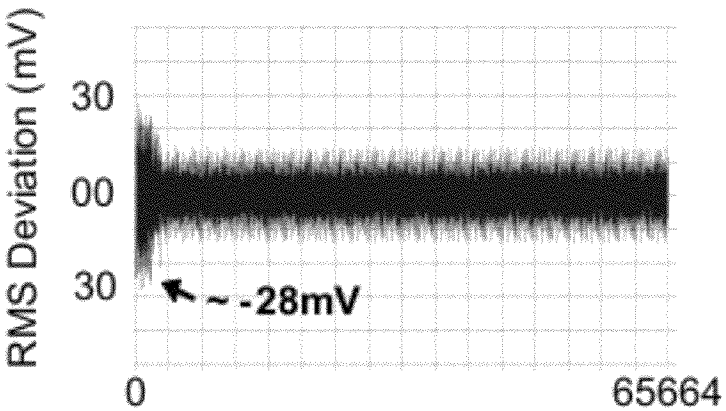

FIG. 7 shows experimental results of the RMS deviations from a conventional source driver (a) and from the source driver of the present invention (b). The maximal deviation from the conventional source driver is about ±28 mV. However, it is about ±19 mV for the source driver of the present invention, which is significantly reduced, compared to the deviation of the conventional source driver.

The present invention, among other things, discloses a source driver that comprises a first digital-to-analog converter with a positive polarity (PDAC), a second digital-to-analog converter with a negative polarity (NDAC), a first operational amplifier and a second operational amplifier. Each operational amplifier is characterized with a 1st & 2nd stage and an output stage. Both the PDAC and NDAC are coupled to the first and second operational amplifiers through a first pair of switches. The 1st & 2nd and output stages of the first operational amplifier are coupled to the 1st & 2nd and output stages of the second operational amplifier through a second pair of switches. The first and second operational amplifiers are coupled to odd data lines and even data line through a third pair of switches. Further, the amplitudes of the operational voltages for the PDAC, the NDAC and the output stages first and second operational amplifiers are set to be between the supply voltage and the ground voltage. Accordingly, the power consumption and the operational temperature are substantially reduced.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A source driver for driving a display having a plurality of pixels spatially arranged in a matrix form, and a plurality of data lines, each data line being associated with pixels of a corresponding pixel column, comprising:

(a) a first pair of switches, a second pair of switches, and a third pair of switches, controlled by a control signal;

(b) a first level shifter having a first input for receiving an input data, a second input for receiving a power supply voltage, a third input for receiving a first middle voltage, and an output for outputting a first level-shifted signal of the input data;

(c) a second level shifter having a first input for receiving the input data, a second input for receiving a second middle voltage, a third input for receiving a ground voltage, and an output for outputting a second level-shifted signal of the input data;

(d) a first digital-to-analog converter with a positive polarity (PDAC) having a first input electrically coupled to the output of the first level shifter for receiving the first level-shifted signal therefrom, a second input for receiving the power supply voltage, a third input for receiving the first middle voltage, a fourth input for receiving a Gamma voltage, and an output for outputting a first converted signal;

(e) a second digital-to-analog converter with a negative polarity (NDAC) having a first input electrically coupled to the output of the second level shifter for receiving the second level-shifted signal therefrom, a second input for receiving the second middle voltage, a third input for receiving the ground voltage, a fourth input for receiving the Gamma voltage, and an output for outputting a second converted signal;

(f) a first analog circuit having a first input electrically coupled to the output of the PDAC and the output of the NDAC through one of the first pair of switch for receiving the first converted signal from the PDAC or the second converted signal from the NDAC, a second input for receiving the power supply voltage, a third input for receiving the ground voltage, and an output for outputting a first amplified signal;

(g) a second analog circuit having a first input electrically coupled to the output of the PDAC and the output of the NDAC through the other of the first pair of switch for receiving the first converted signal from the PDAC or the second converted signal from the NDAC, a second input for receiving the power supply voltage, a third input for receiving the ground voltage, and an output for outputting a second amplified signal;

(h) a first output stage with a positive polarity having a first input electrically coupled to the output of the first analog circuit and the output of the second analog circuit through one of the second pair of switch for receiving the first amplified signal from the first analog circuit or the second amplified signal from the second analog circuit, a second input for receiving the power supply voltage, a third input for receiving the first middle voltage, and an output for outputting a first data signal; and (i) a second output stage with a negative polarity having a first input electrically coupled to the output of the first analog circuit and the output of the second analog circuit through the other of the second pair of switch for receiving the first amplified signal from the first analog circuit or the second amplified signal from the second analog circuit, a second input for receiving the second middle voltage, a third input for receiving the ground voltage, and an output for outputting a second data signal, wherein each odd data line of the plurality of data line are electrically coupled to the output of the first output stage and the output of the second output stage through one of the third pair of switch for receiving the first data signal from the first output stage or the second data signal from the second output stage;

wherein each even data line of the plurality of data line are electrically coupled to the output of the first output stage and the output of the second output stage through the other of the third pair of switch for receiving the first data signal from the first output stage or the second data signal from the second output stage; and wherein the third pair of switches is configured such that each odd data line of the plurality of data line receives one of the first and second data signals, while each even data line of the plurality of data line receives the other of the first and second data signals, and vice versa.

2. The source driver of claim 1, wherein the first and second converted signals have positive and negative polarities, respectively.

3. The source driver of claim 1, wherein the first and second data signals have positive and negative polarities, respectively.

4. The source driver of claim 3, wherein the control signal has a low state and a high state, wherein when the control signal is in the high state, each odd data line of the plurality of data line receives the first data signal, while each even data line of the plurality of data line receives the second data signal, and wherein when the control signal is in the low state, each odd data line of the plurality of data line receives the second data signal, while each even data line of the plurality of data line receives the first data signal.

5. The source driver of claim 1, wherein each of the first middle voltage and the second middle voltage is less than the power supply voltage and greater than the ground voltage.

6. The source driver of claim 5, wherein the first middle voltage and the second middle voltage are identical to or different from each other.

7. The source driver of claim 6, wherein each of the first middle voltage and the second middle voltage is equal to or less than a half of the power supply voltage.

8. The source driver of claim 1, wherein the first analog circuit and the second analog circuit are identical to or different from each other.

9. The source driver of claim 1, wherein the first analog circuit and the first output stage constitute a first operational amplifier, and wherein the second analog circuit and the second output stage constitute a second operational amplifier.

10. A method for driving a display having a plurality of pixels spatially arranged in a matrix form, and a plurality of data lines, each data line being associated with pixels of a corresponding pixel column, comprising the steps of:

(a) providing a power supply voltage, a ground voltage, a first middle voltage, a second middle voltage, and a control signal, having a low state and a high state; and (b) providing a source driver comprising:

(i) a first pair of switches, a second pair of switches, and a third pair of switches, controlled by the control signal;

(ii) a first level shifter having a first input for receiving an input data, a second input for receiving the power supply voltage, a third input for receiving a first middle voltage, and an output for outputting a first level-shifted signal of the input data;

(iii) a second level shifter having a first input for receiving the input data, a second input for receiving the second middle voltage, a third input for receiving the ground voltage, and an output for outputting a second level-shifted signal of the input data;

(iv) a first digital-to-analog converter with a positive polarity (PDAC) having a first input electrically coupled to the output of the first level shifter for receiving the first level-shifted signal therefrom, a second input for receiving the power supply voltage, a third input for receiving the first middle voltage, a fourth input for receiving a Gamma voltage, and an output for outputting a first converted signal;

(v) a second digital-to-analog converter with a negative polarity (NDAC) having a first input electrically coupled to the output of the second level shifter for receiving the second level-shifted signal therefrom, a second input for receiving the second middle voltage, a third input for receiving the ground voltage, a fourth input for receiving the Gamma voltage, and an output for outputting a second converted signal;

(vi) a first analog circuit having a first input electrically coupled to the output of the PDAC and the output of the NDAC through one of the first pair of switch for receiving the first converted signal from the PDAC or the second converted signal from the NDAC, a second input for receiving the power supply voltage, a third input for receiving the ground voltage, and an output for outputting a first amplified signal;

(vii) a second analog circuit having a first input electrically coupled to the output of the PDAC and the output of the NDAC through the other of the first pair of switch for receiving the first converted signal from the PDAC or the second converted signal from the NDAC, a second input for receiving the power supply voltage, a third input for receiving the ground voltage, and an output for outputting a second amplified signal;

(viii) a first output stage with a positive polarity having a first input electrically coupled to the output of the first analog circuit and the output of the second analog circuit through one of the second pair of switch for receiving the first amplified signal from the first analog circuit or the second amplified signal from the second analog circuit, a second input for receiving the power supply voltage, a third input for receiving the first middle voltage, and an output for outputting a first data signal; and (ix) a second output stage with a negative polarity having a first input electrically coupled to the output of the first analog circuit and the output of the second analog circuit through the other of the second pair of switch for receiving the first amplified signal from the first analog circuit or the second amplified signal from the second analog circuit, a second input for receiving the second middle voltage, a third input for receiving the ground voltage, and an output for outputting a second data signal, wherein each odd data line of the plurality of data line are electrically coupled to the output of the first output stage and the output of the second output stage through one of the third pair of switch for receiving the first data signal from the first output stage or the second data signal from the second output stage;

wherein each even data line of the plurality of data line are electrically coupled to the output of the first output stage and the output of the second output stage through the other of the third pair of switch for receiving the first data signal from the first output stage or the second data signal from the second output stage; and wherein the third pair of switches is configured such that each odd data line of the plurality of data line receives one of the first and second data signals, while each even data line of the plurality of data line receives the other of the first and second data signals, and vice versa.

11. The method of claim 10, wherein when the control signal is in the high state, each odd data line of the plurality of data line receives the first data signal, while each even data line of the plurality of data line receives the second data signal, and wherein when the control signal is in the low state, each odd data line of the plurality of data line receives the second data signal, while each even data line of the plurality of data line receives the first data signal.

12. The method of claim 10, wherein each of the first middle voltage and the second middle voltage is less than the power supply voltage and greater than the ground voltage.

13. The method of claim 12, wherein the first middle voltage and the second middle voltage are identical to or different from each other.

14. The method of claim 13, wherein each of the first middle voltage and the second middle voltage is equal to or less than a half of the power supply voltage.

15. A source driver for driving a display having a plurality of pixels spatially arranged in a matrix form, and a plurality of data lines, each data line being associated with pixels of a corresponding pixel column, comprising:

(a) a first pair of switches, a second pair of switches, and a third pair of switches, controlled by a control signal;

(b) a first digital-to-analog converter with a positive polarity (PDAC) having an output for outputting a first converted signal having a positive polarity;

(c) a second digital-to-analog converter with a negative polarity (NDAC) having an output for outputting a second converted signal having a negative polarity;

(d) a first operational amplifier comprising:

(i) a 1st & 2nd stage having a first input electrically coupled to the output of the PDAC and the output of the NDAC through one of the first pair of switch for receiving the first converted signal from the PDAC or the second converted signal from the NDAC, a second input for receiving a power supply voltage, a third input for receiving a ground voltage, and an output for outputting a first amplified signal; and (ii) an output stage having a first input, a second input for receiving the power supply voltage, a third input for receiving a first middle voltage, and an output for outputting a first data signal; and (e) a second operational amplifier comprising:

(iii) a 1st & 2nd stage having a first input electrically coupled to the output of the PDAC and the output of the NDAC through the other of the first pair of switch for receiving the first converted signal from the PDAC or the second converted signal from the NDAC, a second input for receiving the power supply voltage, a third input for receiving the ground voltage, and an output for outputting a second amplified signal; and (iv) an output stage having a first input, a second input for receiving a second middle voltage, a third input for receiving the ground voltage, and an output for outputting a second data signal;

wherein the first input of the output stage of the first operational amplifier is electrically coupled to the output of the 1st & 2nd stage of the first operational amplifier and the output of the 1st & 2nd stage of the second operational amplifier through one of the second pair of switch for receiving the first amplified signal from the 1st & 2nd stage of the first operational amplifier or the second amplified signal from the 1st & 2nd stage of the second operational amplifier;

wherein the first input of the output stage of the second operational amplifier is electrically coupled to the output of the 1st & 2nd stage of the first operational amplifier and the output of the 1st & 2nd stage of the second operational amplifier through the other of the second pair of switch for receiving the first amplified signal from the 1st & 2nd stage of the first operational amplifier or the second amplified signal from the 1st & 2nd stage of the second operational amplifier;

wherein each odd data line of the plurality of data line are electrically coupled to the output of the output stage of the first operational amplifier and the output of the output stage of the second operational amplifier through one of the third pair of switch for receiving the first data signal from the output stage of the first operational amplifier or the second data signal from the output stage of the second operational amplifier;

wherein each even data line of the plurality of data line are electrically coupled to the output of the output stage of the first operational amplifier and the output of the output stage of the second operational amplifier through the other of the third pair of switch for receiving the first data signal from the output stage of the first operational amplifier or the second data signal from the output stage of the second operational amplifier; and wherein the third pair of switches is configured such that each odd data line of the plurality of data line receives one of the first and second data signals, while each even data line of the plurality of data line receives the other of the first and second data signals, and vice versa.

16. The source driver of claim 15, further comprising:

(a) a first level shifter having a first input for receiving an input data, a second input for receiving the power supply voltage, a third input for receiving the first middle voltage, and an output for outputting a first level-shifted signal of the input data; and (b) a second level shifter having a first input for receiving the input data, a second input for receiving the second middle voltage, a third input for receiving the ground voltage, and an output for outputting a second level-shifted signal of the input data.

17. The source driver of claim 16, wherein the PDAC further comprises a first input electrically coupled to the output of the first level shifter for receiving the first level-shifted signal therefrom, a second input for receiving the power supply voltage, a third input for receiving the first middle voltage, a fourth input for receiving a Gamma voltage; and wherein the NDAC further comprises a first input electrically coupled to the output of the second level shifter for receiving the second level-shifted signal therefrom, a second input for receiving the second middle voltage, a third input for receiving the ground voltage, a fourth input for receiving the Gamma voltage, and an output for outputting a second converted signal having a negative polarity.

18. The source driver of claim 17, wherein the first and second converted signals have positive and negative polarities, respectively.

19. The source driver of claim 15, wherein the first and second data signals have positive and negative polarities, respectively.

20. The source driver of claim 19, wherein the control signal has a low state and a high state, wherein when the control signal is in the high state, each odd data line of the plurality of data line receives the first data signal, while each even data line of the plurality of data line receives the second data signal, and wherein when the control signal is in the low state, each odd data line of the plurality of data line receives the second data signal, while each even data line of the plurality of data line receives the first data signal.

21. The source driver of claim 15, wherein each of the first middle voltage and the second middle voltage is less than the power supply voltage and greater than the ground voltage.

22. The source driver of claim 21, wherein the first middle voltage and the second middle voltage are identical to or different from each other.

23. The source driver of claim 22, wherein each of the first middle voltage and the second middle voltage is equal to or less than a half of the power supply voltage.

24. A method for driving a display having a plurality of pixels spatially arranged in a matrix form, and a plurality of data lines, each data line being associated with pixels of a corresponding pixel column, comprising the steps of:

(a) providing a power supply voltage, a ground voltage, a first middle voltage, a second middle voltage, and a control signal, having a low state and a high state; and (b) providing a source driver comprising:

(i) a first pair of switches, a second pair of switches, and a third pair of switches, controlled by the control signal;

(ii) a first digital-to-analog converter with a positive polarity (PDAC) having an output for outputting a first converted signal having a positive polarity;

(iii) a second digital-to-analog converter with a negative polarity (NDAC) having an output for outputting a second converted signal having a negative polarity;

(iv) a first operational amplifier comprising:

a 1st & 2nd stage having a first input electrically coupled to the output of the PDAC and the output of the NDAC through one of the first pair of switch for receiving the first converted signal from the PDAC or the second converted signal from the NDAC, a second input for receiving the power supply voltage, a third input for receiving the ground voltage, and an output for outputting a first amplified signal, and an output stage having a first input, a second input for receiving the power supply voltage, a third input for receiving the first middle voltage, and an output for outputting a first data signal; and (v) a second operational amplifier comprising:

a 1st & 2nd stage having a first input electrically coupled to the output of the PDAC and the output of the NDAC through the other of the first pair of switch for receiving the first converted signal from the PDAC or the second converted signal from the NDAC, a second input for receiving the power supply voltage, a third input for receiving the ground voltage, and an output for outputting a second amplified signal, and an output stage having a first input, a second input for receiving the second middle voltage, a third input for receiving the ground voltage, and an output for outputting a second data signal;

wherein the first input of the output stage of the first operational amplifier is electrically coupled to the output of the 1st & 2nd stage of the first operational amplifier and the output of the 1st & 2nd stage of the second operational amplifier through one of the second pair of switch for receiving the first amplified signal from the 1st & 2nd stage of the first operational amplifier or the second amplified signal from the 1st & 2nd stage of the second operational amplifier;

wherein the first input of the output stage of the second operational amplifier is electrically coupled to the output of the 1st & 2nd stage of the first operational amplifier and the output of the 1st & 2nd stage of the second operational amplifier through the other of the second pair of switch for receiving the first amplified signal from the 1st & 2nd stage of the first operational amplifier or the second amplified signal from the 1st & 2nd stage of the second operational amplifier;

wherein each odd data line of the plurality of data line are electrically coupled to the output of the output stage of the first operational amplifier and the output of the output stage of the second operational amplifier through one of the third pair of switch for receiving the first data signal from the output stage of the first operational amplifier or the second data signal from the output stage of the second operational amplifier;

wherein each even data line of the plurality of data line are electrically coupled to the output of the output stage of the first operational amplifier and the output of the output stage of the second operational amplifier through the other of the third pair of switch for receiving the first data signal from the output stage of the first operational amplifier or the second data signal from the output stage of the second operational amplifier; and wherein the third pair of switches is configured such that each odd data line of the plurality of data line receives one of the first and second data signals, while each even data line of the plurality of data line receives the other of the first and second data signals, and vice versa.

25. The method of claim 24, wherein when the control signal is in the high state, each odd data line of the plurality of data line receives the first data signal, while each even data line of the plurality of data line receives the second data signal, and wherein when the control signal is in the low state, each odd data line of the plurality of data line receives the second data signal, while each even data line of the plurality of data line receives the first data signal.

26. The method of claim 24, wherein each of the first middle voltage and the second middle voltage is less than the power supply voltage and greater than the ground voltage.

27. The method of claim 26, wherein the first middle voltage and the second middle voltage are identical to or different from each other.

28. The method of claim 27, wherein each of the first middle voltage and the second middle voltage is equal to or less than a half of the power supply voltage.

* * * * *